United States Patent [19]

Hoover et al.

[11] Patent Number: 4,852,444

[45] Date of Patent: Aug. 1, 1989

[54] ELECTRO-MECHANICAL TRANSDUCER WHICH COUPLES POSITIVE ACOUSTIC FEEDBACK INTO AN ELECTRIC AMPLIFIED GUITAR BODY FOR THE PURPOSE OF SUSTAINING PLAYED NOTES

[76] Inventors: Alan A. Hoover, R.R. 2, Box 124, New Palestine, Ind. 46163; Gary T. Osborne, 6052 North Guilford Ave., Indianapolis, Ind. 46220

[21] Appl. No.: 937,871

[22] Filed: Dec. 4, 1986

[51] Int. Cl.[4] ..... G10H 3/18; G10H 3/26

[52] U.S. Cl. ..... 84/1.05; 84/1.15; 84/1.16; 84/DIG. 10

[58] Field of Search ..... 84/1.05, 1.14–1.16, 84/DIG. 10, 1.24, DIG. 26

[56] References Cited

U.S. PATENT DOCUMENTS

| | | | |
|---|---|---|---|
| 1,893,895 | 1/1933 | Hammond, Jr. . | |
| 2,204,529 | 6/1940 | Cooley . | |
| 2,249,158 | 7/1941 | Morrison . | |
| 2,545,007 | 3/1951 | Schultheis, Jr. . | |
| 3,178,512 | 4/1965 | Ashworth . | |
| 3,194,870 | 7/1965 | Tondreau et al. . | |
| 3,334,195 | 8/1967 | Ashworth . | |
| 3,449,531 | 6/1969 | Ashworth . | |
| 3,584,161 | 6/1971 | Hawley . | |
| 3,937,904 | 2/1976 | Parker . | |
| 4,015,227 | 3/1977 | Riko et al. . | |
| 4,130,043 | 12/1978 | Niimi | 84/DIG. 10 |
| 4,151,368 | 4/1979 | Fricke et al. | 84/DIG. 10 |
| 4,151,379 | 4/1979 | Ashworth . | |
| 4,275,267 | 6/1981 | Kurtin et al. | 84/DIG. 26 |
| 4,389,915 | 6/1983 | Bione | 84/1.24 |
| 4,438,525 | 3/1984 | Shibata et al. | 84/DIG. 26 |
| 4,484,508 | 11/1984 | Nourney | 84/1.05 |
| 4,506,117 | 3/1985 | Fresard . | |
| 4,603,321 | 7/1986 | Gutman | 84/1.01 X |
| 4,655,115 | 4/1987 | Nishimoto | 84/DIG. 10 |

FOREIGN PATENT DOCUMENTS 5975800 10/1982 Japan .

OTHER PUBLICATIONS

"Ebow the Electronic Bow for Guitar", Heet Sound Products, Los Angeles.

*Primary Examiner*—S. J. Witkowski
*Attorney, Agent, or Firm*—Barnes & Thornburg

[57] ABSTRACT

A transducer for a musical instrument through which vibrations can be fed back to the instrument so that notes played on the instrument can be sustained. The transducer comprises a bracket for mounting the transducer to the instrument. First and second opposited permanent magnetic poles project away from the bracket. A first surface of a sheet of non-magnetic, non-electromagnetic resilient material is attached to the projecting first and second magnetic poles. An electromagnetic core has a spine and first and second legs originating at, and extending away from, the spine and terminating at first and second end faces, respectively. The first and second end faces are attached to a surface of the sheet opposite the surface of the sheet to which the permanent magnetic poles are attached, with the first face adjacent the first permanent magnetic pole and the second face adjacent the second permanent magnetic pole. A conductor is wound on the core. Varying current flow in the conductor induces flux variations in the core.

14 Claims, 7 Drawing Sheets

ELECTRO-MECHANICAL TRANSDUCER WHICH COUPLES POSITIVE ACOUSTIC FEEDBACK INTO AN ELECTRIC AMPLIFIED GUITAR BODY FOR THE PURPOSE OF SUSTAINING PLAYED NOTES

The invention has been described in the context of an electric guitar and its related components. However, the invention is believed to be useful with other types of musical instruments, notably stringed instruments, whether fretted or not.

Since its inception in the late 1940's, the electric amplified guitar has become a very popular musical instrument. Many playing styles have evolved, and some have reached high levels of sophistication. No other instrument has had a greater impact on the development of rock music than the electric guitar.

One technique used by many rock guitarists is sustaining or prolonging the time duration of a played note. This is usually referred to simply as "sustain". It is often considered desirable to utilize the sustain effect during guitar solos in rock music.

It was recognized early in the evolution of rock music that by increasing the volume setting on guitar amplifiers, a plucked note would sustain its original volume level for a significant period of time (often several seconds) before beginning to "die out," even though the vibration amplitude of the string might immediately begin its natural logarithmic decay due to mechanical damping losses.

There are several techniques which use high volume level settings on guitar amplifiers to cause notes to sustain. Two of these involve non-linear compression of waveform peaks.

The first of these techniques is so-called amplifier "clipping". Most musical instrument amplifiers comprise several voltage gain stages in cascade, with a final output stage which may or may not have voltage gain. Most of the vacuum tube amplifiers made in the 1950's and 1960's were constructed in this manner, wherein the individual pre-amp voltage gain stages were cascaded, and were not contained within an overall feedback loop. By increasing the input voltage level beyond some reference voltage amplitude, the dynamic range of such an amplifier is exceeded, that is, the amplifier saturates, and clipping occurs in one or more of the voltage gain stages. The clipping amplitude is normally approximately equal to the D.C. power supply voltage of the amplifier, minus voltage drops across amplifier components. If the input signal voltage is increased further (FIG. 1*a*), output voltage peaks cannot increase, due to the clipping (FIG. 1*b*).

This is a crude form of waveform compression, which imparts some harmonic distortion to the aplified signal appearing across the amplifier output terminals. It produces a sustain effect if the amplifier is overdriven a considerable amount. This occurs because, although the plucked string vibration naturally decays in amplitude, the corresponding amplified peak voltage amplitude at the amplifier output does not decay until the amplifier comes out of clipping. This is best illustrated at time $t_1$ of FIG. 1*b*. The perceived change in volume as the string vibration decays is difficult to detect until clipping ceases.

A similar effect occurs at high loudness levels due to non-linear loudspeaker operation, assuming conventional magnetic voice coil cone-type loudspeakers. The acoustic "clipping" that results is normally less harsh sounding than amplifier overdrive because there is less harmonic distortion with this form of "sustain" than with amplifier overdriving and the resulting "clipping" distortion. Two factors combine to produce this phenomenon of non-linear loudspeaker operation. They are non-linear suspension compliance, and non-linear magnetic force on the voice coil. Considering non-linear suspension compliance first, at normal design playing levels for a typical loudspeaker, the restoring forces exerted by the cone suspension and voice coil suspension are linear and proportional to the cone excursion. Larger excursions produced by louder playing levels stretch the cone suspension. Larger force is therefore required to move the cone a given distance. Consequently, a compression (and resulting sustain of plucked notes) occurs. Next considering non-linear magnetic force on the voice coil, at normal playing levels, the voice coil of a typical loudspeaker moves through a relatively constant magnetic flux, resulting in the magnetic force on the voice coil being essentially proportional to current through it. At the ends of the magnetic voice coil gap, however, the flux density decreases, due in some part to flux leakage. Large excursions produced by loud playing cause portions of the voice coil to move in these areas of low flux density. The result is a non-linear relationship between voice coil current and force on the voice coil, causing reduced cone excursion and reduction of acoustic output during waveform peaks. Once again, a compression, with resulting sustain, occurs.

A third technique by which sustain can be achieved is acoustic feedback from guitar loudspeakers to guitar body and strings. Depending upon the amplifier acoustic power output available, guitar body construction, distance between amplifier loudspeakers and guitar, and ambient acoustic conditions, sufficient energy can be coupled from loudspeakers to guitar to excite the strings into sustained vibration by means of positive acoustic feedback. The amount of coupled energy can be so great as to cause the string vibration amplitude to increase to a point at which a runaway oscillatory condition occurs, limited eventually by amplifier clipping and/or loudspeaker compression.

A fourth technique closely akin to the third is for the guitarist to bring some structural component of his guitar, illustratively the headstock, into contact with some component of the speaker enclosure, such as a speaker baffle, when he wants to sustain a note. Mechanical vibration of the baffle is fed back through the heatstock into the guitar, causing positive feedback of string oscillations under appropriate conditions, resulting in sustain. Again the amount of energy fed back can be enough to drive the amplifier into clipping.

Many modern guitar amplifiers are equipped with circuitry designed to produce deliberate clipping. The typical circuitry consists of voltage gain stages and spectral shaping circuits. Controls are usually provided to control the amount of overdrive. A number of accessory "sustainer" or "distortion-substainer" products are also available which contain signal-level circuitry to accomplish the same purpose. These are usually inserted into the signal path between guitar and amplifier. Other types of circuits are manufactured and sold for the purpose of sustaining guitar notes. These include linear compressors which are essentially linear voltage aplifiers containing DC voltage-controlled gain stages. The gain control device is usually a voltage-controlled resistor, either a field effect transistor (FET—see FIG. 2*a*) or a cadmium sulfide (CdS—see FIG. 2*b*) photocell. A DC voltage having an amplitude which is proportional to the voltage output of the guitar is formed by rectifying and filtering an amplifier guitar output signal. The DC voltage is then applied to the gain element which is configured to reduce the voltage gain of the stage as the guitar signal level increases. In the case of a photocell, the DC voltage powers a lamp which shines on the CdS cell. The result of an input signal such as the signal of FIG. 3*a* from a guitar is a relatively constant output voltage as the input signal dies out, as shown in FIG. 3*b*. The main difference in the output signals of FIGS. 1*b* and 3*b* is that less harmonic distortion is present in the output signal of FIG. 3*b*, since no clipping has occurred. In reality, however, voltage gain devices of the type discussed here and illustrated in FIGS. 2*a–b* do exhibit some distortion due to non-linear transfer characteristics.

A more recently available sustain circuit, the Boss super distortion feedback model DF-1 manufactured by Roland Corporation, 7200 Dominion Circle, Los Angeles, Calif. 90040, (FIG. 4) "locks on" to a note utilizing a phase-locked loop. An internal voltage-controlled oscillator is phase-locked to a played note when a switch is closed, e.g. by depressing a foot pedal. The phase-locked oscillator locks onto the frequency of the played note and remains at that frequency until the switch is opened. If a new note is plucked at the guitar, or if the original note is modified by some pitch change technique by the guitarist, such as string bending or mechanical vibrato, the phase-locked oscillator signal will not respond accordingly until the switch is opened and closed again. The serious limitations described in this discussion of the prior art do not exist with the present invention.

According to one aspect of the invention, a transducer is provided for a musical instrument. The musical instrument has an instrument body through which vibrations can be fed back to the instrument to sustain notes played on the instrument. The transducer comprises a core constructed from electromagnetic material, the core having a spine and a pair of legs extending away from the spine, a resilient, non-electromagnetic, non-magnetic material, a conductor wound on the core so that energization of the conductor causes opposite magnetic poles to exist at the end faces of the legs remote from the spine, and means for mounting the transducer on the instrument body. A permanent magnetic pole is associated with each leg and means for mounting the permanent magnetic poles adjacent end faces of respective legs between the means for mounting the transducer on the instrument body and the resilient material with the permanent magnetic poles being opposite.

According to another aspect of the invention, a combination includes a musical instrument and a transducer. The transducer comprises a core constructed from electromagnetic material, the core having a spine, and first and second legs extending away from the spine, a generally flat sheet of a non-electromagnetic, non-magnetic resilient material, means for mounting the core on a surface of the resilient material, a conductor wound on the core so that energization of the conductor causes opposite magnetic poles to occur at end faces of the first and second legs remote from the spine, first and second permanent magnetic poles for the first and second legs, respectively, means for mounting the permanent magnetic poles adjacent the end faces of respective legs on a surface of the resilient material opposite the surface on which the core is mounted with the permanent magnetic poles poled in opposite directions, means for mounting the transducer upon the musical instrument, and means for feeding back electrical signals corresponding to musical note vibrations to the conductor to sustain such vibrations.

Illustratively, according to these aspects of the invention, the core is somewhat E-shaped, the pair of legs comprising an end leg and a center leg. The transducer further comprises another end leg, a third permanent magnetic pole and means for mounting the third permanent magnetic pole adjacent an end face of said other end leg between the means for mounting the transducer on the instrument body and the resilient material with the third permanent magnetic pole being opposite to the permanent magnetic pole adjacent the end face of the center leg.

Additionally according to illustrative embodiments of these aspects of the invention, the means for mounting the transducer on the instrument body comprises a bracket, means for attaching the three permanent magnetic poles to the bracket so that opposite first and second permanent magnetic poles project away from the bracket, like first and third permanent magnetic poles project away from the bracket, and the second permanent magnetic pole lies generally between the first and third permanent magnetic pole, and means for mounting the bracket on the instrument body.

According to yet another aspect of the invention, a transducer is provided for a musical instrument so that vibrations can be fed back to the instrument so that notes played on the instrument can be sustained. The transducer comprises a bracket for mounting the transducer to the instrument, a first permanent magnetic pole, means for mounting the first permanent magnetic pole to the bracket, the first permanent magnetic pole projecting away from the bracket, a second permanent magnetic pole, and means for mounting the second permanent magnetic pole to the bracket, the second permanent magnetic pole projecting away from the bracket, the second permanent magnetic pole being opposite to the first. The transducer further includes a sheet of a non-magnetic, non-electromagnetic resilient material, means for attaching a first surface of the sheet of resilient material to the projecting first and second magnetic poles, an electromagnetic core having a spine and first and second legs originating at, and extending away from, the spine and terminating at first and second end faces, respectively, and a conductor wound on the core. Varying current flow in the conductor thus induces flux variations in the core. The transducer further includes means for attaching the first and second end faces to a surface of the sheet opposite the surface of the sheet to which the permanent magnetic poles are attached, with the first face adjacent the first permanent magnetic pole and the second face adjacent the second permanent magnetic pole.

Illustratively according to this aspect of the invention, the transducer further comprises a third permanent magnetic pole, means for mounting the third permanent magnetic pole to the bracket with the third permanent magnetic pole projecting away from the bracket, the third permanent magnetic pole being like the first permanent magnetic pole, means for attaching the first surface of the sheet of resilient material to the projecting third magnetic pole, the electromagnetic core further including a third leg originating at, and extending away from, the spine and terminating at a third end face, and means for attaching the third end face to the surface of the sheet opposite the surface to which the permanent magnetic poles are attached, with the third face adjacent the third permanent magnetic pole.

Additionally according to an illustrative embodiment of this aspect of the invention, the first and third magnetic poles are mounted on the bracket in spaced orientation with the second permanent magnetic pole mounted on the bracket generally between them.

According to another aspect of the invention, a splitter is provided for splitting a high level voltage signal and for providing a selected first portion of the split signal to a first channel characterized by an inductive load and for providing a selected second portion of the split signal to a second channel. The splitter comprises a pair of input terminals for coupling a high level voltage signal source to the splitter, a first pair of output terminals for coupling the splitter to the first channel, a second pair of output terminals for coupling the splitter to the second channel, a first resistor, and means for coupling the first resistor in series between one of the input terminals and one of the first pair of output terminals. The means for coupling the first resistor in series between one of the input terminals and one of the first pair of output terminals includes first and second switches which are alternately actuable. Actuation of the first switch couples said one of the input terminals to a first of the first pair of output terminals. Actuation of the second switch couples said one of the input terminals to a second of the first pair of output terminals.

According to an illustrative embodiment of this aspect of the invention, the splitter further comprises means for indicating whether the first switch or the second switch is actuated. Illustratively, the indicating means comprises an LED, and means for coupling the LED to said first of the first pair of output terminals. Actuation of the first switch energizes the LED.

Additionally according to an illustrative embodiment of this aspect of the invention, the indicating means further comprises a second LED, and means for coupling the second LED to said second of the first pair of output terminals. Actuation of the second switch energizes the second LED.

According to an illustrative embodiment of this aspect of the invention, the splitter further comprises a third switch, and means for coupling the third switch in series between one of the input terminals and the first and second switches.

According to an alternative embodiment of this aspect of the invention, the second channel is characterized by means for coupling the second channel to an audio transducer and a dummy load. The means for coupling the second channel to an audio transducer includes a third switch having a first position in which the dummy load is coupled across the input terminals, coupling of the second channel to an audio transducer moving the third switch to a second position in which the dummy load is removed from circuit across the input terminals and replaced by the audio transducer. Illustratively, the dummy load comprises a second resistor.

According to an illustrative embodiment of this aspect of the invention, the splitter further comprises a third resistor, and means for coupling the third resistor in series between one of the input terminals and one the second pair of output terminals. The means for coupling the third resistor in series between one of the input terminals and one of the second pair of output terminals includes a fourth switch having a first position in which the third resistor is in series between one of the input terminals and one of the second pair of output terminals and a second position in which the third resistor is not in series between one of the input terminals and one of the second pair of output terminals.

Illustratively according to this aspect of the invention, the splitter further comprises a fourth resistor, and means for coupling the fourth resistor in series between one of the input terminals and one of the second pair of output terminals. The means for coupling the fourth resistor in series between one of the input terminals and one of the second pair of output terminals includes the fourth switch. The fourth switch has a third position in which the third and fourth resistors are in circuit between one of the input terminals and one of the second pair of output terminals. Illustratively, the third position of the fourth switch comprises a position in which the third and fourth resistors are in parallel with each other and in series between one of the input terminals and one of the second pair of output terminals.

According to yet another aspect of the invention, a system is provided for feeding back musical note vibrations to a musical instrument to sustain the playing time of the musical note on the instrument. The instrument is sensitive to the phase of the vibrations fed back to it. The system comprises means for conditioning an electrical signal corresponding to the played note to provide a conditioned electrical signal at a level at which the conditioned electrical signal can be fed back to the musical instrument to sustain the playing time of the musical note, means for coupling the musical instrument to the conditioning means, and means for coupling the conditioning means to the musical instrument. The conditioning means comprises means for controllably varying the phase between the played note and the conditioned electrical signal.

According to an illustrative embodiment of this aspect of the invention, the means for controllably varying the phase between the played note and the electrical signal comprises means for providing a selectively variable time delay.

Illustratively, the means for providing a selectively variable time delay comprises a digital shift register having an input terminal and an output terminal, an analog-to-digital (A/D) converter, a digital-to-analog (D/A) converter, means for coupling the A/D converter to the input terminal of the digital shift register and means for coupling the output terminal of the digital shift register to the D/A converter. At least one of the input terminal to the digital shift register and the output terminal from the digital shift register is selectively variable to provide the selectively variable time delay.

Alternatively the means for providing a selectively variable time delay comprises a series of charge-coupled devices (CCDs) having an input terminal and an output terminal. At least one of the input terminal to the series of CCDs and the output terminal from the series of CCDs is selectively variable to provide the selectively variable time delay.

According to an illustrative embodiment of this aspect of the invention, the means for conditioning the electrical signal corresponding to the played note to provide a conditioned electrical signal for feeding back to the instrument comprises an audio amplifier, a splitter, a loudspeaker, and a transducer. Means are provided for coupling the musical instrument to the audio amplifier to amplify the level of the electrical signal, for coupling the audio amplifier to the splitter to split the amplified signal into two channels, for coupling the splitter to the loudspeaker to provide an audio signal corresponding to the musical note, for coupling the splitter to the transducer, and for coupling the transducer to the musical instrument to feed back to the musical instrument mechanical vibrations corresponding to the musical note to sustain the playing time of the musical note.

According to yet another aspect of the invention, a splitter is provided for splitting a high level voltage signal, for providing a selected first portion of the split signal to a first channel and for providing a selected second portion of the split signal to a second channel. The splitter comprises a pair of input terminals for coupling a high level voltage signal source to the splitter, a first pair of output terminals for coupling the splitter to the first channel, and a second pair of output terminals for coupling the splitter to the second channel. The second channel includes means for coupling the second channel to an audio transducer. The splitter includes a dummy load. The means for coupling the second channel to an audio transducer includes a switch having a first position in which the dummy load is coupled across the input terminals. Coupling of the second channel to an audio transducer moves the switch to a second position in which the dummy load is removed from circuit across the input terminals and replaced by the audio transducer.

According to an illustrative embodiment of this aspect of the invention, the dummy load comprises a resistor.

Further according to an illustrative embodiment of this aspect of the invention, the splitter further comprises a second of resistor, and means for coupling the second resistor in series between one of the input terminals and one of the second pair of output terminals. The means for coupling the second resistor in series between one of the input terminals and one of the second pair of output terminals includes a second switch having a first position in which the second resistor is in series between one of the input terminals and one of the second pair of output terminals and a second position in which the second resistor is not in series between one of the input terminals and one of the second pair of output terminals.

Additionally according to an illustrative embodiment of this aspect of the invention, the splitter comprises a third resistor, and means for coupling the third resistor in series between one of the input terminals and one of the second pair of output terminals. The means for coupling the third resistor in series between one of the input terminals and one of the second pair of output terminals includes the second switch, the second switch having a third position in which the second and third resistors are in circuit between one of the input terminals and one of the second pair of output terminals. Illustratively, the third position of the second switch comprises a position in which the second and third resistors are in parallel with each other and in series between one of the input terminals and one of the second pair of output terminals.

According to another aspect of the invention, a system is provided for feeding back musical note vibrations to a musical instrument to sustain the playing time of the musical note on the instrument. The system comprises means for conditioning an electrical signal corresponding to the played note to provide a conditioned electrical signal at a level at which the conditioned electrical signal can be fed back to the musical instrument to sustain the playing time of the musical note. The system also includes a transducer, means for mounting the transducer on the musical instrument, means for coupling the musical instrument to the conditioning means, and means for coupling the conditioning means to the transducer.

The invention may best be understood by referring to the following description and accompanying drawings which illustrate the invention. In the drawings:

FIG. 1*a* illustrates a typical electric guitar output voltage waveform as a function of time;

FIG. 1*b* illustrates a typical overdriven electric guitar amplifier outpput voltage waveform as a function of time;

FIG. 2*a* illustrates a partly block and partly schematic diagram of a typical linear compressor employing a field effect transistor as a gain control element;

FIG. 2*b* illustrates a partly block and partly schematic diagram of a typical linear compressor employing a cadmium sulfide cell as a gain control element;

FIG. 3*a* illustrates a typical electric guitar output voltage waveform as a function of time.;

FIG. 3*b* illustrates a typical output voltage waveform available from a linear compressor of the type illustrated in FIGS. 2*a–b;*

Figure 1A:
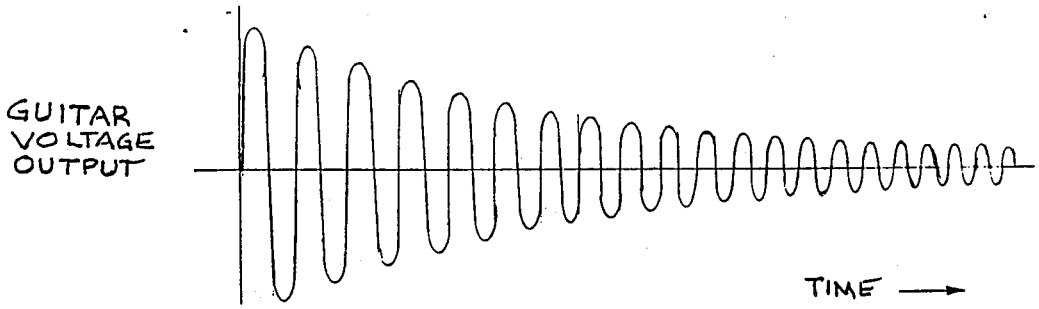
PRIOR ART FIG. 1a
Figure 1B:
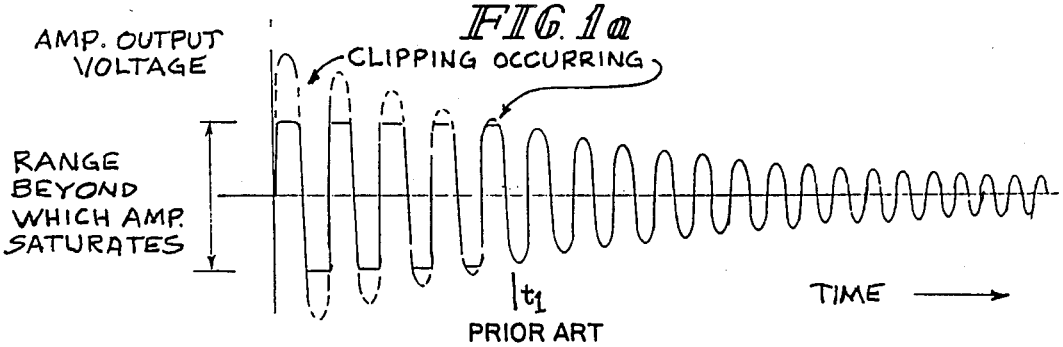
PRIOR ART FIG. 1b
Figure 2A:
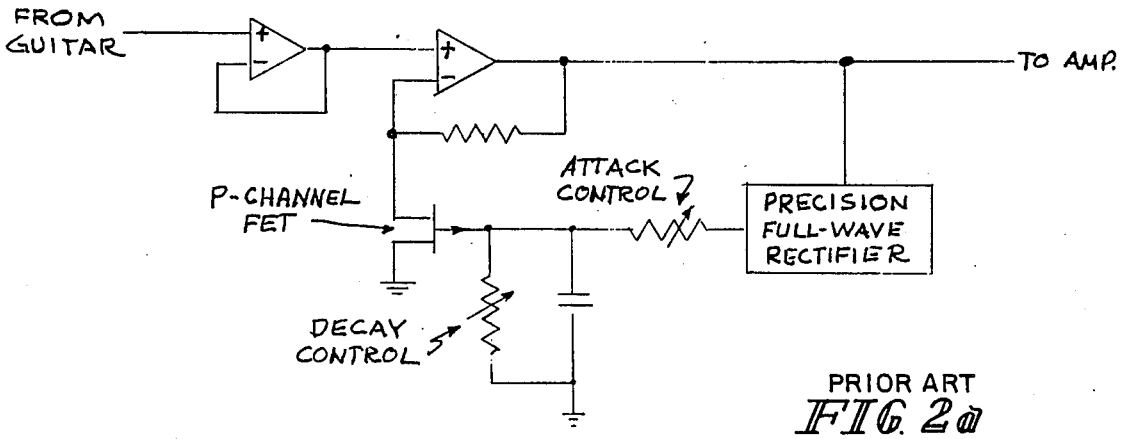
PRIOR ART FIG. 2a
Figure 2B:
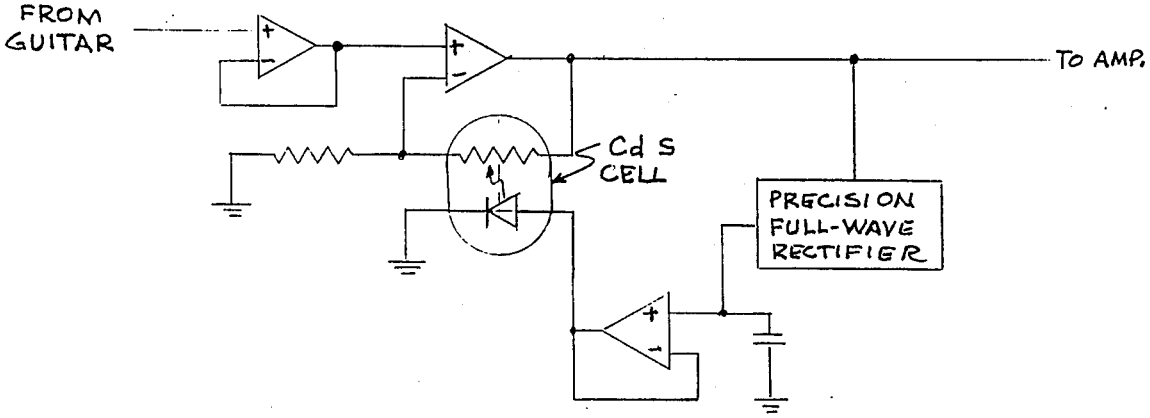
PRIOR ART FIG. 2b
Figure 3A:
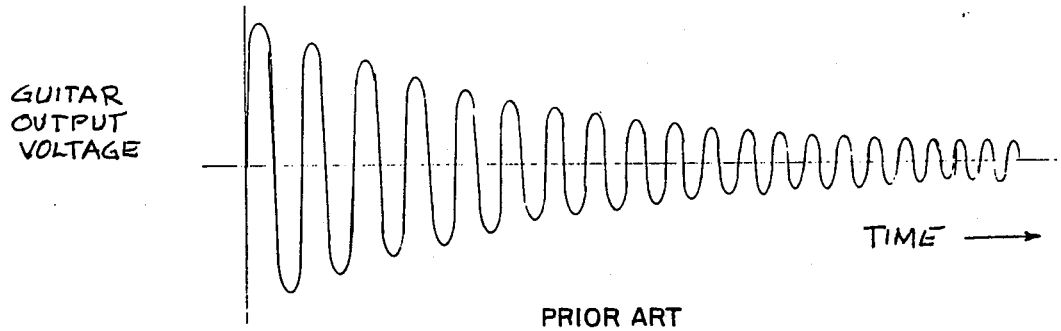
PRIOR ART FIG. 3a
Figure 3B:
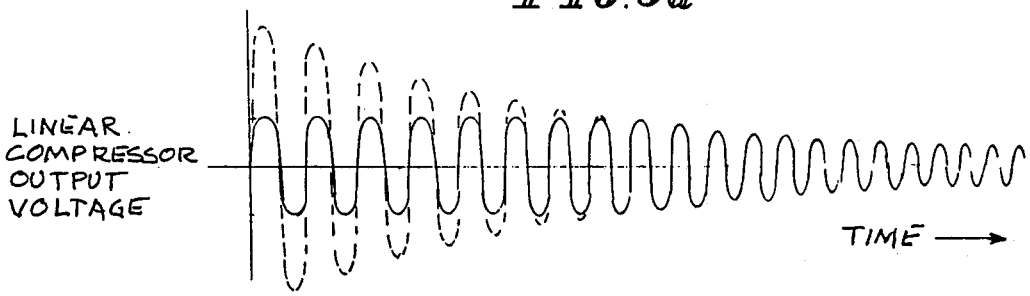
PRIOR ART FIG. 3b
Figure 4:
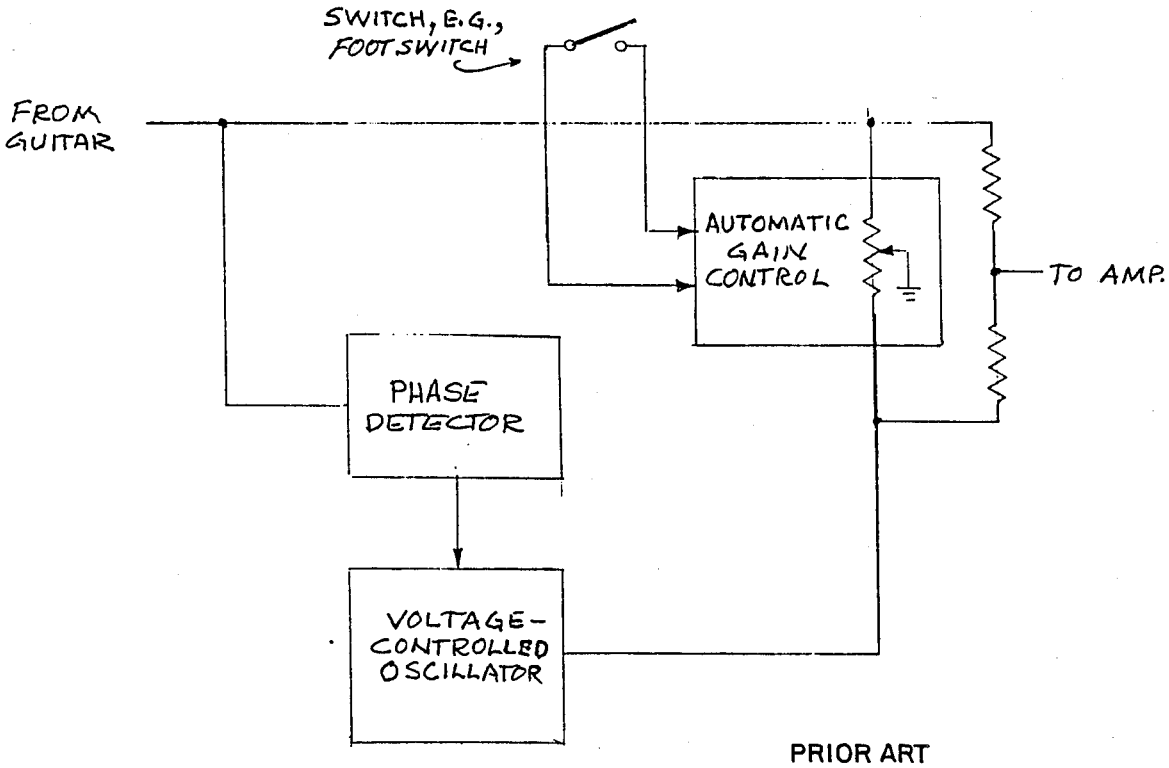
PRIOR ART FIG. 4
FIG. 4 illustrates a partly block and partly schematic diagram of a commercially available sustain circuit.
Figure 5:
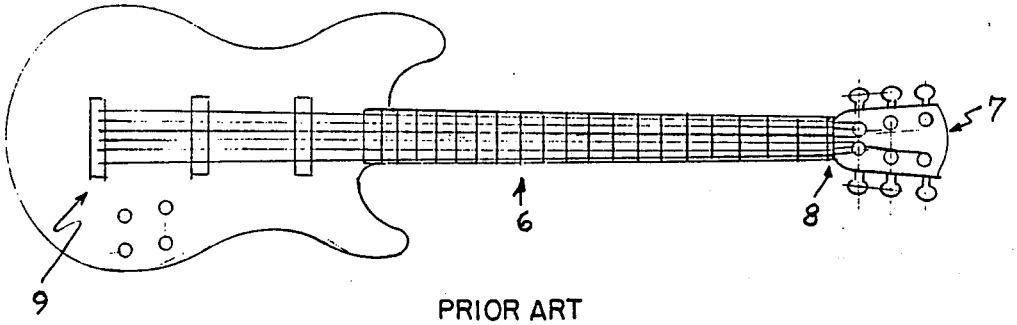
PRIOR ART FIG. 5
FIG. 5 illustrates a top plan view of an electric guitar.

The invention comprises an electroacoustic transducer designed to couple positive acoustic feedback from guitar amplifier to guitar body and strings in a manner not unlike the above-described acoustic feedback technique. However, instead of coupling the acoustic energy into the guitar from loudspeakers through air, an amplifier drives a transducer mounted directly to some part of the guitar, such as the guitar body, which can, in turn, transmit energy to the strings. These guitar parts to which the transducer can be mounted include, but are not limited to, the neck 6, headstock 7, nut body 8 and bridge 9. See FIG. 5. The transducer can be powered by the same amplifier that drives the speakers, or the transducer can be powered by a separate amplifier. The transducer amplifier need not be a conventional linear audio amplifier, but can be designed to provide harmonic distortion for harmonic enrichment of string vibration and/or cost reduction. In general, more flexibility of musical performance can be obtained by powering the transducer by a separate amplifier. Tone controls can then be used to enrich the resulting sound by selectively accentuating desired frequencies. A foot- or hand-actuated volume control can be used to modulate the transducer power, allowing the guitarist complete control over the sustain effect. If sufficient power is applied to the transducer, sustained string vibration will occur.

The operating principle of the transducer is based upon applying force to some part of the guitar by means of magnetic attraction and repulsion at audio frequencies. A major factor in the design of the device is simplicity of construction. All major magnetic portions of the device have been selected to be readily available.

Figure 6:
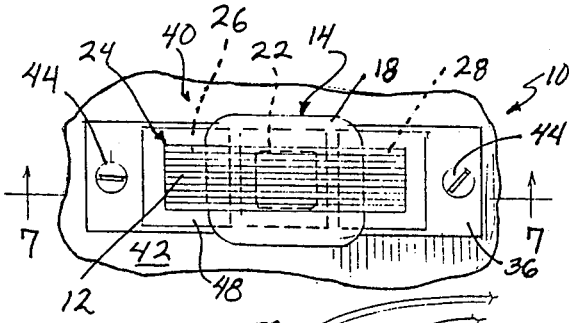
FIG. 6 illustrates a top plan view of a transducer constructed according to the present invention.
Figure 7:
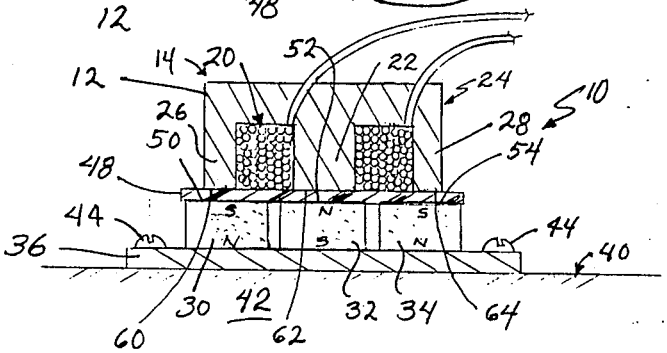
FIG. 7 illustrates a sectional view of the transducer of FIG. 6, taken generally along section lines 7—7 thereof.

Referring now to the transducer 10 of FIGS. 6–7, a stack 12 of standard transformer "E-core" laminations comprises the magnetic core 14 of the device 10. A bobbin 18 wound with wire 20 is placed over the center leg 22 of the E-core stack 12. The resulting assembly 24 is typical of mass-produced transformers made throughout the world for many years. The difference here is that no "I-core" is provided across the ends of the three legs 26, 22, 28, to complete the magnetic circuit, as would be the case for a transformer.

Three permanent magnets 30, 32, 34 are mounted with cement to a steel plate 36. The magnets 30, 32, 34 are polarized as illustrated. The steel plate 36 has four purposes: it provides a mounting for the magnets 30, 32, 34; it provides a low-reluctance magnetic path, eliminating some leakage flux from the magnets 30, 32, 34 so that a more efficient magnetic system can be realized; it forms a mounting bracket so that the device 10 can be mounted to the desired location 40 on a guitar 42 by screws 44 or other means; and it couples acoustic energy from the transducer 10 to the guitar 42.

A piece 48 of resilient material, such as a resilient plastic or rubber foam, is cemented to the end surfaces 50, 52, 54 of the three magnets 30, 32, 34, respectively. The assembly 24 is attached to the resilient material 48. This attachment can be made with cement.

As illustrated in FIG. 7, the orientations and physical sizes of the magnets 30, 32, 34 are such that the end faces 60, 64 of the E-core 14 at attracted by magnetic poles of one polarity (in this case the magnetic "South" poles of magnets 30, 34, respectively) and the face 62 of the E-core 14 is attracted by a magnetic pole of the opposite polarity (in this case the magnetic "North" pole of magnet 32). The polarities of the three magnets 30, 32, 34 can be reversed. Transducer operation is not affected except for phase inversion.

When the transducer coil 20 is coupled to an audio power amplifier, the faces 60, 62, 64 of the E-core 14 will be magnetized with polarities depending on the direction of current flow through the coil 20. Current in one direction through the coil 20 will cause the end face 62 of the center leg 22 of the core 14 to be a magnetic north pole, while the end faces 60, 64 of the two outside legs 26, 28 will become magnetic south poles. Current in the opposite direction will cause the end face 62 of the center leg 22 to become a magnetic south pole, while the end faces 60, 64 of the two outside legs 26, 28 become magnetic north poles. The magnetic flux will be proportional to the current in the coil 20 and the number of turns ($LI=N\phi$). As described earlier, the magnets 30, 32, 34 are mounted to the guitar 42 by plate 36.

Since the desired result is to produce vibratory motion in the guitar 42, the mass of the core/coil assembly 24 should be significant compared to that of the guitar 42 part 6–9, etc. (see FIG. 5) to be vibrated. Otherwise, most of the acoustic energy generated will be imparted to the core/coil assembly 24. This will be appreciated from the following:

Force (F)=proportional to magnetic attraction/repulsion. From Newton's law, a=F/m, a=acceleration, m=mass of object. Since velocity, $$v = \int_{t_1}^{t_2} a\,d\tau = \int_{t_1}^{t_2} \frac{F}{m}\,d\tau = \frac{F}{m}(t_2 - t_1),$$

the less massive object is accelerated to a higher velocity for a given magnetic force between the two objects.

Since the kinetic energy, e, of a moving object is $$\begin{aligned} e &= 1/2\, mv^2 \\ &= 1/2\, m \frac{F^2}{m^2}(t_2 - t_1)^2 = 1/2 \frac{F^2}{m}(t_2 - t_1)^2 \end{aligned}$$

it can be appreciated that for a given force F on an object, as the mass m of the object decreases, its energy increases.

These expressions assume constant force. The transducer 10 described here is, in general, not a linear system, due to the inverse square force versus distance relationship between two objects magnetically attracted.

Under certain circumstances, it may be desirable to control the amount of sustain which the device 10 of FIGS. 6–7 provides, that is, the amount of energy fed back positively through the device 10 to the guitar 42. Under such circumstances, a splitter 80, FIG. 8, can be provided. Splitter 80 is a switching/mixing device which permits the guitarist a certain amount of control over the device 10. Splitter 80 also provides the basic function of dividing amplifier power between the guitar amplifier speaker(s) 81 and transducer 10. See FIG. 10.

Amplified guitar signal is coupled into the splitter 80 through a standard ¼" phone jack 82. Amplifier power is branched to two different processing networks 84, 86. Network 84 supplies power to the transducer 10 through a two-conductor phone jack 88. Network 86 supplies power to the speaker 81 (FIG. 10) through a switched contact phono jack 90.

A 4.7 Ω resistor 94 is placed in series with the transducer 10. This is done for two reasons, both relating to the fact that the transducer 10 presents a largely inductive load to the amplifier. First, the resistance of resistor 94, plus the coil 20 resistance of the transducer 10, plus the resistance of the conductors coupling the transducer 10 to splitter 80, provide a total resistance of approximately 8 Ω. This amount of resistance prevents currents from becoming excessive at low frequencies, when the inductive reactance of the 3.2 mH nominal inductance of the transdcuer 10 is very low. This resistance prevents excessive sustain of low notes relative to high notes. The particular L/R time constant (0.4 msec.) was chosen based on numerous subjective tests with a wide variety of commerically available electric guitars. Second, the resistor 94 prevents large low frequency currents from damaging the amplifier, particularly since the inductive phase shift causes voltage across amplifier output devices to be maximum at the same time that current is maximum, resulting in large instantaneous power dissipation.

Switches 96 and 98 are momentary pushbutton footswitches. Pressing one of these switches 96, 98 applies power to the transducer 10. Switches 96, 98 are wired such that current flow in the transducer 10 is in one direction for a given amplifier current polarity when switch 96 is closed, and current flow in the transdcuer 10 is in the opposite direction with the same amplifier current polarity if switch 98 is closed. Red 100 and green 102 LEDs provide the user with a visual indication of phase polarity, that is, which of switches 96, 98 is closed at any time. Diodes 106, 108 prevent reverse breakover of LEDs 100, 102. Resistor 110 provides proper current limiting for LEDs 100, 102 for amplifier powers of up to 100 W. A metal oxide varistor (MOV) 114 protects the amplifier, wire insulation, and diodes 106, 108 from high voltage transients which are produced by energy stored in the transducer 10 inductance when switch 96 or switch 98 is opened while current is flowing through the transducer coil 20 by dissipating the stored energy and providing a fixed clamp voltage.

Figure 8:
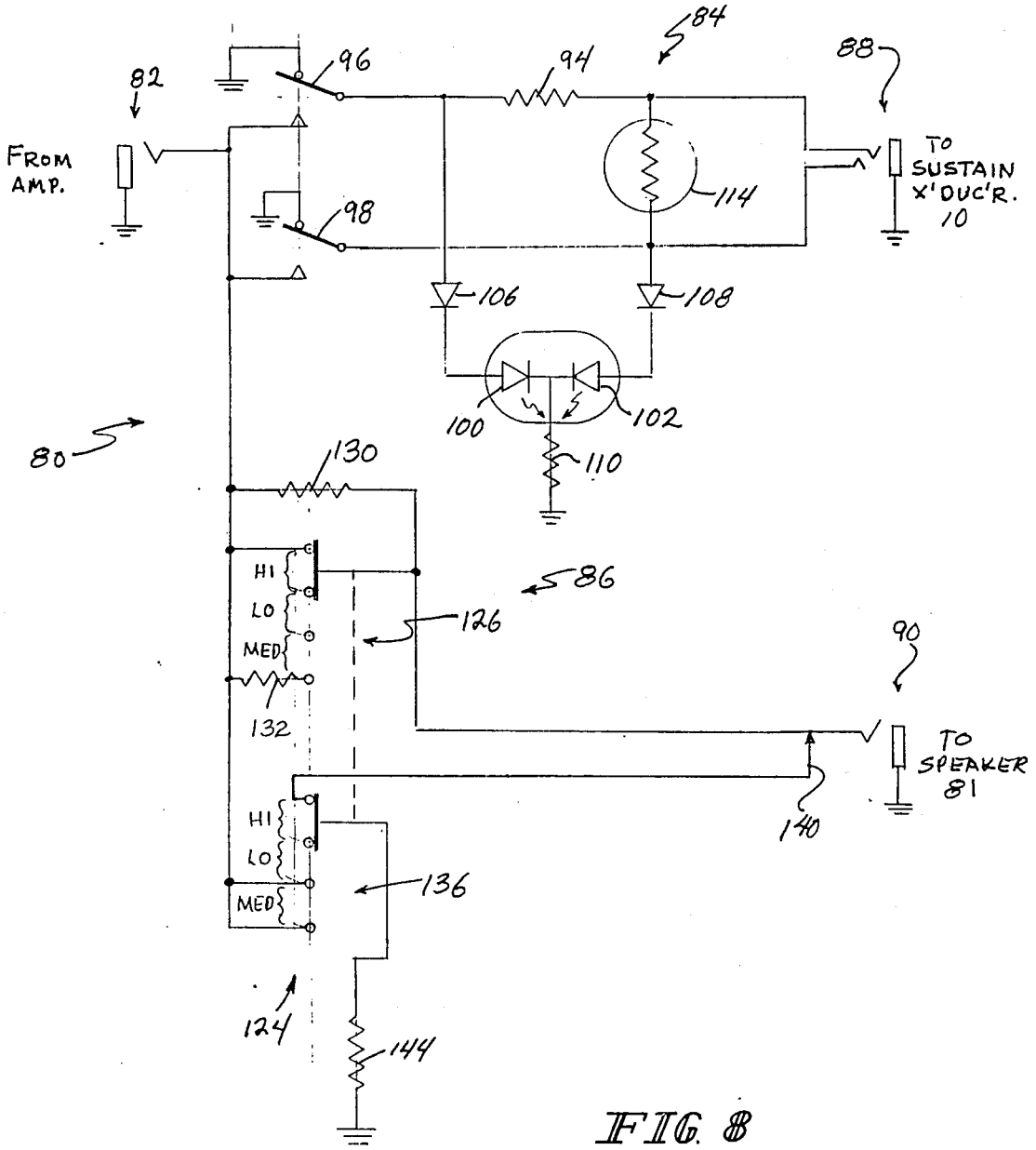
FIG. 8 illustrates a schematic diagram of a signal splitter constructed according to the present invention.
Figure 9:
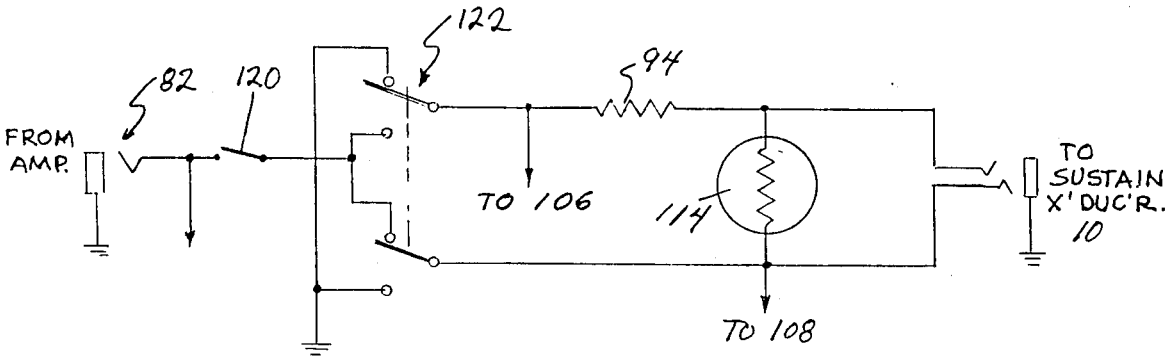
FIG. 9 illustrates a schematic diagram of an alternative detail to a portion of the splitter illustrated in FIG. 8.

An optional switching configuration is shown in FIG. 9. In this configuration, momentary switches 96, 98 are not used. Instead switches 120, 122 are employed. Switches 120, 122 are alternate action pushbutton footswitches. Switch 120 connects and disconnects the transducer 10. Switch 122 is a double pole-double throw switch which provides phase reversal. The two switch configurations illustrated in FIGS. 8, 9 provide distinctly different advantages which enable the musician to achieve flexibility in developing playing styles when using the transducer.

Switch 124 (FIG. 8) provides a dual function. Section 126 of this 2-pole, 3-position switch provides the capability of driving the speaker 81 with two levels of attenuation or with no attenuation, depending on the switch 126 position. For instance, in the "LO" (middle) position, a resistor 130 of 220 ohms resistance is placed in series with the speaker 81, so that a musician may practice at relatively quiet volume levels while still aplying a high power level to the transducer 10. Placing switch 126 in the "MED" position places a resistor 132 of 47 Ω resistance in parallel with the 220 Ω resistor 130 in series with the speaker 81, for a moderal level of attenuation. Placing switch 130 in the "HI" position provides no attenuation of the amplifier output signal supplied to speaker 81.

Section 136 of switch 126, in conjunction with the switched contact 140 of phono jack 90, provides protection for transformer-coupled amplifiers (typically vacuum tube-type amplifiers) when the speaker 81 is disconnected or attenuated by resistors 130, 132. In these cases, a 16 Ω resistor 144 is placed across the amplifier output terminals. Energy stored in the transducer coil 20 inductance causes large voltage transients to appear at the amplifier's transformer primary when operating an amplifier at clipping during switching from one output device (tube or transistor) to the other during the "dead-time" when neither is conducting fully. The 16 Ω resistor 144 dissipates this stored energy. Such dissipation would normally be provided by a speaker load.

When a speaker 81 is connected to phono jack 90, the switched contact 140 of switch section 136 opens, so that the resistor 144 will not use amplifier power unnecessarily. In the "MED" and "LO" switch 126 positions, resistor 144 is connected across the amplifier output terminals at all times.

Figure 10:
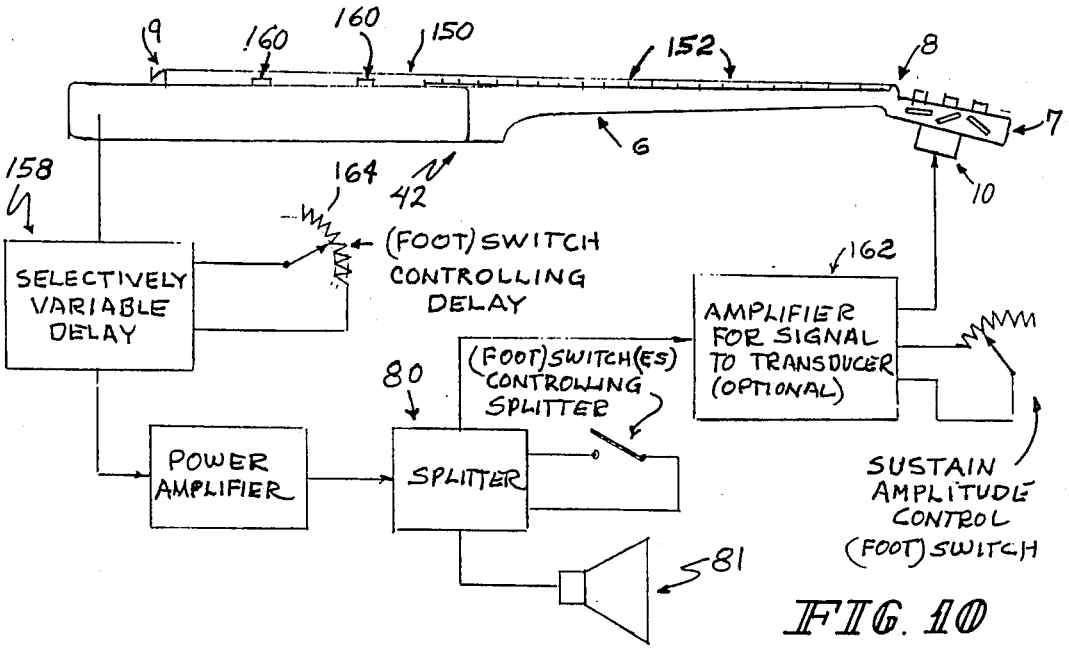
FIG. 10 illustrates a block diagram of a sustain system according to the invention.

The phase reversal feature is an important feature of the splitter 80. With reference now to FIG. 10, when note sustain is achieved by using the transducer 10, it is because vibrational energy reaches the strings 150 of the guitar 42 at their point of contact with an end of the vibrating region of the string, for example, the particular fret 152 being played. When the neck 6 of the guitar is vibrated by the transducer 10, vibrational modes are induced which are a function of the fundamental and harmonic frequencies of the note or notes being played, and of the natural vibration frequency of the neck 6 and its harmonics, and of the position on the neck 6 which is being fretted.

As a result of this complex relationship between strings 150 and neck 6, sustain can occur as the fundamental of a plucked note, or as a harmonic of the note. If a vibrational null of the neck 6 is located at the fret point, no sustain will occur, because no vibrational energy reaches the string 150.

The phase reversal feature provides a means for changing sustain harmonics and of restoring sustain to the null points.

Figure 11:
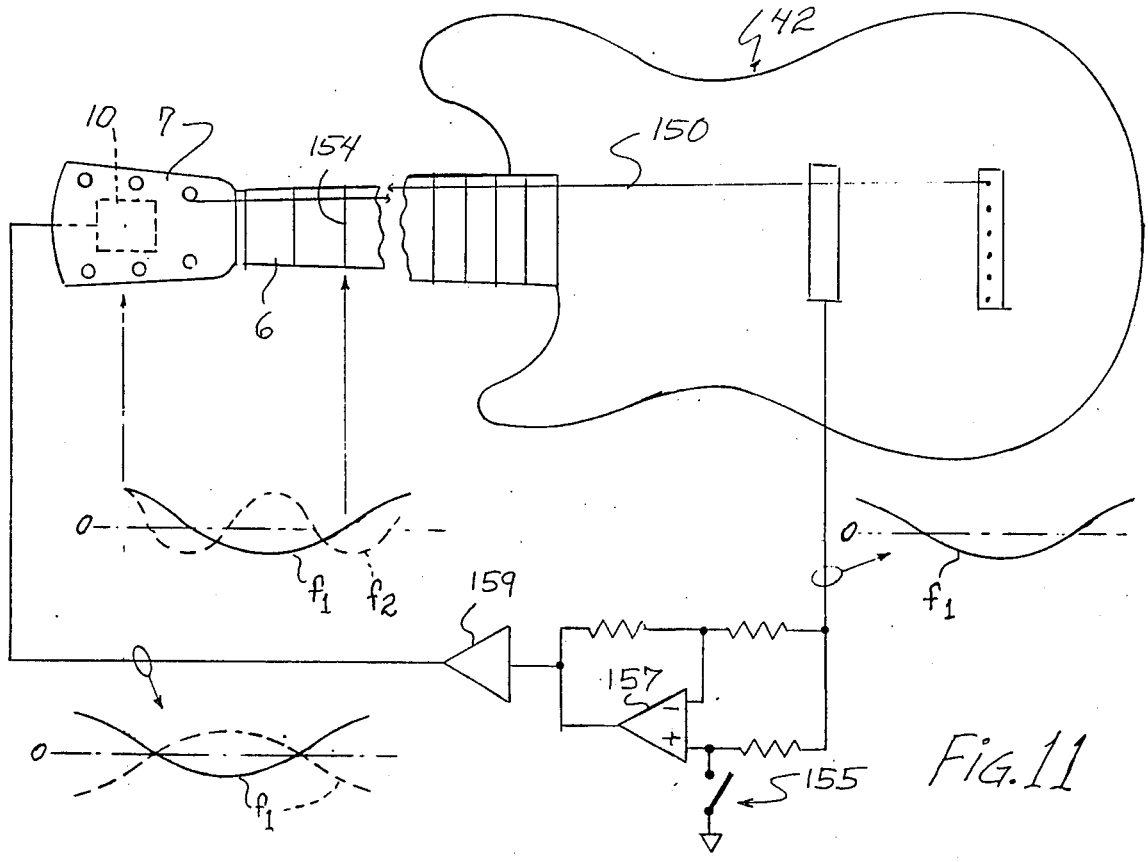
FIG. 11 illustrates a partly fragmentary diagrammatic, partly schematic and partly block diagrammatic view of a sustain system according to the invention, with some waveforms illustrated, which view is presented to explain a feature of the invention.

To illustrate the phase reversal feature, reference is here made to FIG. 11. Assume the guitar neck can be modeled as a pure acoustical time delay line, independent of frequency. Assume the guitar string 150 is fretted at the second fret 154. The lowest two natural harmonic modes of the string are f1, the fundamental frequency, and f2, the first overtone one octave above the fundamental. When the string 150 is played, many harmonic modes are stimulated simultaneously. If the phase reversal switch (96, 98 of FIG. 8 and 122 of FIG. 9, all here represented by switch 155) is open, amplifier 157 does not invert the signal appearing at its+input terminal and the amplifier 159 which drives the transducer 10 drives it with an "in-phase" signal.

The fundamental, f1, travels through the neck 6 and arrives at the second fret 154 with positive amplitude. The first harmonic, f2, arrives at the second fret 154 with negative amplitude. Due to relative polarities, the vibrational amplitude of f1 in the guitar string will increase and the vibrational amplitude of f2 will decrease during the moments following excitation of the guitar string 150. In fact, f2 will diminish practically to zero and f1 will increase until some limitation of the system is reached. One such limitation might be the maximum power output of the power amplifier. A listener will perceive the system as being "locked" on f1, the fundamental of the fretted note in this case.

If switch 155 is closed, amplifier 157 inverts the guitar signal and the amplifier 159 drives the transducer 10 with an "out-of-phase" guitar signal. The relative polarities of f1 and f2 will be reversed and f2 will increase while f1 diminishes. A listener will perceive the system as being "locked" on f2, the first harmonic of the fretted note.

For purposes of this explanation, it has been assumed that the guitar neck 6 is a pure acoustical time delay line. The guitar neck 6, however, it not a pure, frequency independent delay. It is a complex mechanical resonator with a natural harmonic resonance of its own. In fact, the transducer 10 stimulates harmonic resonances in the entire guitar 42 including the guitar body, the bridge 9, and the mechanical supports of the guitar pickups. To predict the harmonic response of the system for a specific guitar is beyond the scope of this explanation.

As was mentioned in the discussion of the splitter circuits 80 of FIGS. 8–9, guitar neck 6 vibrational modes have a strong influence on the ability to achieve sustained notes due to acoustic feedback. Also, the harmonic structure of the sustained note is partially dependent on the vibrational mode of the neck 6. This property of the vibrational mechanism of the neck 6 has been utilized to provide an apparatus which can be used to alter the harmonic structures of sustained notes at will.

If the acoustic transducer 10 is mounted to the headstock 7 of the guitar 42, acoustic energy travels through the neck 6 at the speed of sound in the material being used for the neck 6. For individual guitars, particular shapes and construction materials will cause variations in the speed of sound. In short, different guitars will sustain notes differently, with different vibrational null points, different harmonic responses, etc. Also contributing to these differences are other variables, such as string thickness, electric pickup tonality differences, temperature, humidity, amplifier equalization, etc. In short, no two guitars will behave identically, and the performance of a guitar will change from time to time. However, if a time-delay device 158 is utilized to delay the time between electrical output from the guitar pickup 160 and the amplified output of the transducer 10 amplifier 162, the phase relationship between neck 6 vibration and string 150 vibration can be altered.

By providing a means 158 of altering the time delay, this phase relationship can be controlled at will by the musician. Many electronic devices are available to accomplish time delay of the desired interval.

Sound travels the length of a typical guitar neck (about 2 feet) in the range of approximately one millisecond. This duration of time delay can be achieved electronically by several well-known circuit configurations, all represented by block 158, such as a digital shift register, utilizing A/D and D/A conversion, a bucket-brigade integrated circuit utilizing a series of charge-coupled devices (CCDs), capacitors connected in an arrangement in which charge is transferred by switching from one capacitor to another in sequence, such as in the SAD 1024 integrated circuit manufactured by Reticon Corporation, 345 Potrero Avenue, Sunnyvale, Calif. 94086.

If a foot pedal potentiometer 164 is used to control the time delay between about 0.1 and 10 milliseconds, the musician can play the guitar 42 normally, using both hands while varying the time-delayed signal to the transducer 10. In this manner, null points can be eliminated so that "dead frets" do not occur. Also, note harmonics can be altered during the performance in order to embellish the resulting sound.

Figure 12:
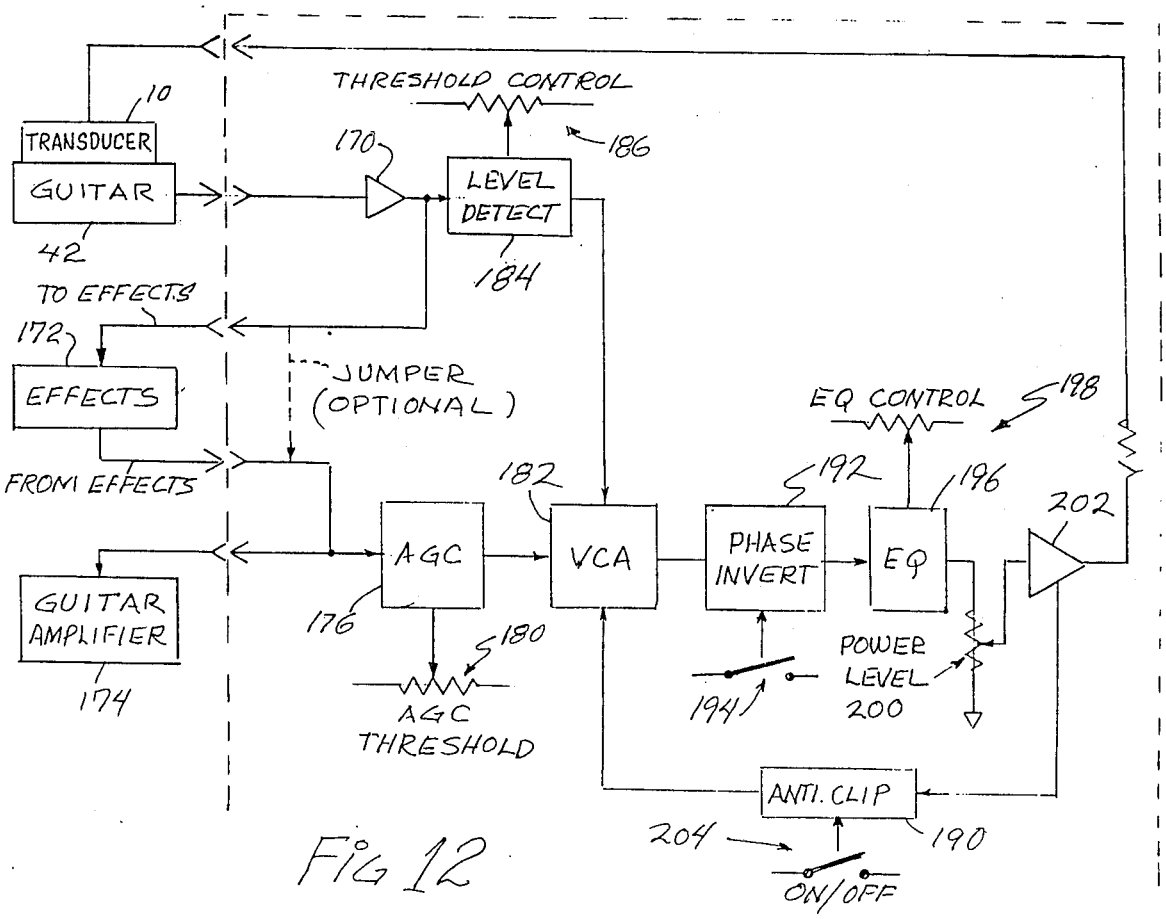
FIG. 12 illustrates a block diagram of a system incorporating several features of the invention.

FIG. 12 illustrates in block diagram form a system incorporating several of the feature previously discussed. Signal from the guitar 42 is coupled to an input terminal of an input buffer amplifier 170. The output terminal of amplifier 170 is coupled to a "TO EFFECTS" terminal where the buffered signal is available to be supplied to several sources of externally generated effects such as distortion booster, chorus, and the like. These effects and the devices that produce them are known among rock guitarists and need not be discussed further here. The various sources of such effects are represented in FIG. 12 by block 172, EFFECTS. If no effects are used, the TO EFFECTS output must be shorted to the FROM EFFECTS input to the system.

The output signal FROM EFFECTS 172 is supplied to the power amplifier 174 and as an input signal to an automatic gain control (AGC) circuit 176. Another input terminal of AGC 176 is coupled to the wiper of a potentiometer 180 which supplies an AGC threshold voltage above which circuit 176 maintains a constant output level for signals supplied to it. The output terminal from AGC 176 is coupled to an input terminal of a voltage controlled amplifier (VCA) 182.

The output terminal of buffer amplifier 170 is also coupled to an input terminal of a level detector 184, another input terminal of which is coupled to the wiper of a threshold control potentiometer 186. The output signal from the level detector 184 is coupled to an "enable" terminal of the VCA 182. When a signal of sufficient magnitude reaches level detector 184, it enables the VCA 182. The potentiometer 186 permits the guitarist to set the level at which the VCA 182 will be enabled, typically at such a level that plucking of a note by the guitarist will enable the VCA 182, but a lower level signal will not enable it. The VCA 182 provides on/off control of the transducer 10 and gain control for an anti-clipping circuit 190 in a feedback loop with VCA 182.

The output terminal of the VCA 182 is coupled to an input terminal of a phase inverter 192 of the type described in connection with FIGS. 8–9. Typically, one input to the phase inverter 192 is the positions of one or more switches 194. See switches 96, 98, 122 in FIGS. 8–9. The output signal from the phase inverter 192 is coupled to an input terminal of an equalizer 196. Equalizer 196 also has an input terminal coupled to the wiper of an equalization control potentiometer 198. The output terminal of equalizer 196 is coupled through a power level selecting potentiometer 200 to common.

Figure 14A:
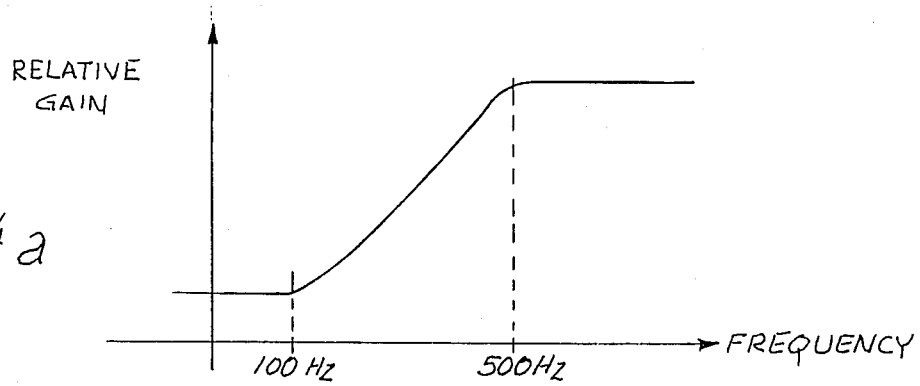
FIG. 14*a–c* illustrate waveforms which are achieved by the operation of the system illustrated in FIGS. 12–13.
Figure 14B:
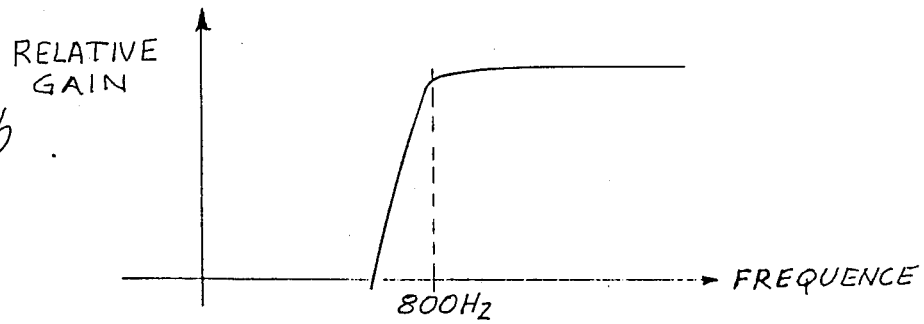
Figure 14C:
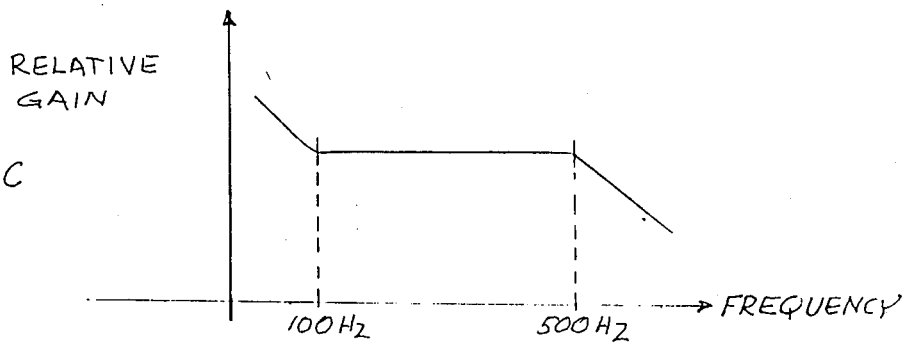

The characteristic of the equalizer can be selected from a number of different optional characteristics, three selected ones of which are illustrated in FIGS. 14*a–c*. In FIG. 14*a*, a normal equalization gain characteristic is illustrated. The characteristic is flat below 100 Hz, rising at, for example, 20 dB/decade between 100 Hz and 500 Hz (about 2¼ octaves in the range of the fundamental frequencies of guitar strings), and flat from 500 Hz up. This characteristic is the complement of the transducer 10 characteristic and effectively equalizes the system characteristic to flat. With this equalization characteristic, the transducer has an approximately equal chance of being driven at the fundamental frequency of the plucked note or at a harmonic of that frequency.

In FIG. 14*b*, a characteristic which results in harmonic enhancement is illustrated. This gain characteristic would be chosen, for example, if the guitarist wanted to sustain higher harmonics of the fundamental note played. The characteristic rises sharply, at a 40–60 dB/decade, or stepper, rate to 800 Hz, at which frequency it breaks flat. Selection of this equalization characteristic makes it more likely that the transducer will be driven at some harmonic rather than the fundamental, because of the attenuation of the fundamental.

A gain characteristic which reduces the likelihood of squeal is illustrated in FIG. 14*c*. This characteristic falls at, for example, a 20 dB/decade rate to 100 Hz, is flat between 100 Hz and 500 Hz, and falls at a 20 dB/decade rate above 500 Hz. If this characteristic is chosen, the system will have the greatest chance of the three characteristics illustrated of locking on the fundamental frequency since the higher harmonics are attenuated more. This mode or characteristic also attenuates high frequency noise which can be induced in the guitar pickups 160 by EM radiation from the transducer 10.

The wiper of potentiometer 200 is coupled to an input terminal of a transducer power amplifier 202, the output terminal of which is coupled through a power resistor such as the 4.7 Ω resistor 94 of FIG. 8 to the transducer 10. Feedback is coupled from a feedback terminal of amplifier 202 to an input terminal of the switch 204-controlled anti-clipping circuit 190. The output terminal of the anti-clipping circuit feeds back a control signal to the VCA 182.

When a note is played on guitar 42, the level detector 184 enables the VCA 182. Assuming ON/OFF control switch 204 is ON, the guitar signal passes from the effects 172 (or in the absence of effects, through the shorted EFFECTS terminals) to the phase inverter 192. The signal passes through the phase inverter 192 either inverted or unaltered, depending upon the switch 194 position.

The signal is then conditioned to a selected equalization characteristic, such as those illustrated in FIGS. 14*a–c*, depending upon the equalization control 198 setting. The equalized signal drives the transducer 10 through its power amplifier 202. The power level control 200 controls the average power with which the transducer 10 is driven and therefore the average energy with which the guitar strings 150 are vibrated. If control 200 is set too high, or the peak amplitude of the guitar signal is high, the power amplifier 202 will be driven into clipping and the transducer 10 drive to the guitar is distorted and "fuzzy." This fuzz is detectable. However, as the power amplifier 202 begins to clip, the peak positive and negative excursions of the anti-clip signal supplied to circuit 190 rise rapidly. Circuit 190 rectifies these peaks and feeds them back to the VCA 182 to reduce its voltage gain. The high sensitivity of circuit 190 does not permit power amplifier 202 to go very far into clipping before the input signal supplied through VCA 182 to it is reduced to minimize clipping in amplifier 202.

Figure 13:
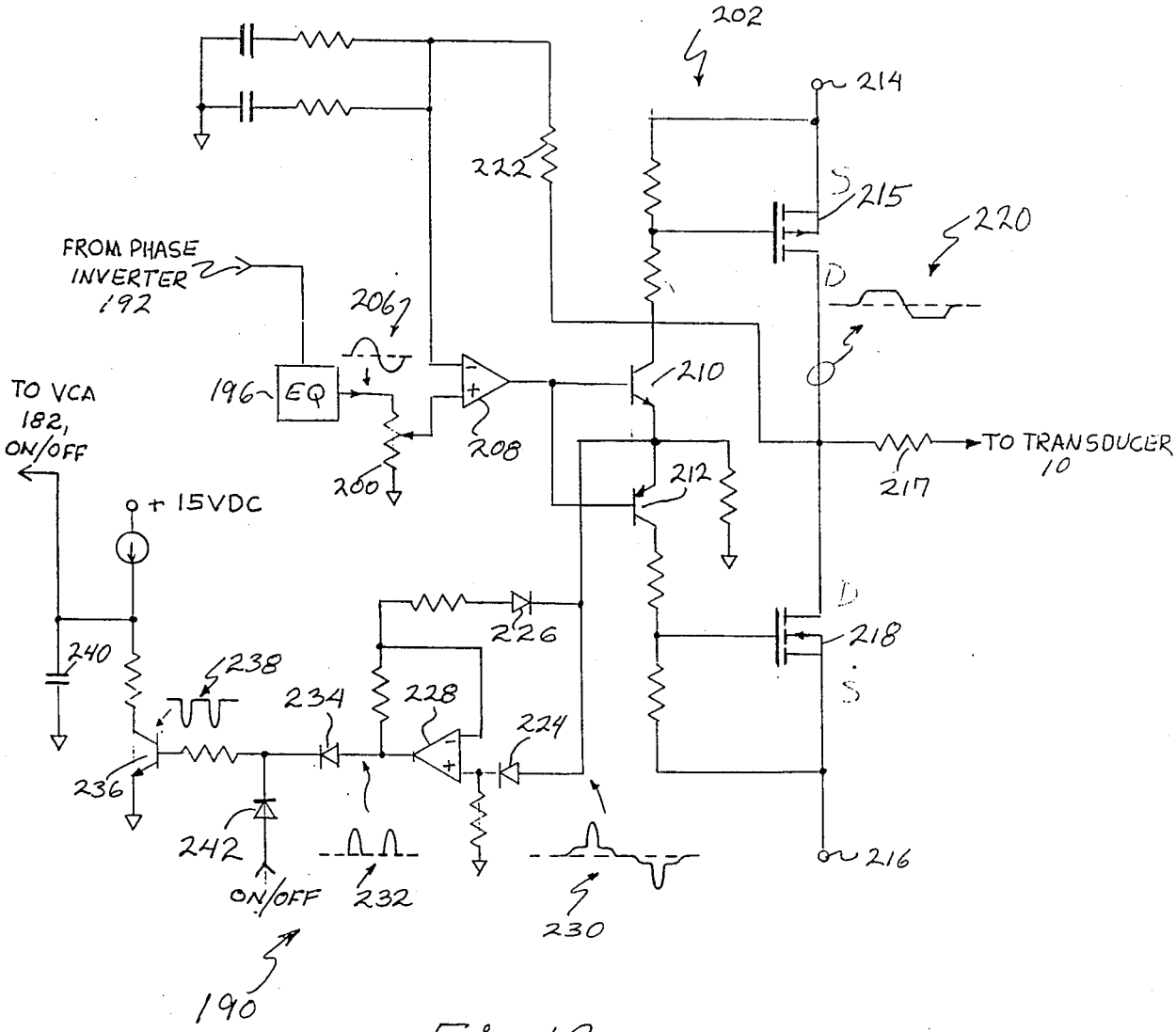
FIG. 13 illustrates a partly block and partly schematic diagram of portions of the system of FIG. 12 with some waveforms illustrated for purposes of explanation of its operation.

FIG. 13 illustrates partly schematically the anti-clipping circuit 190 and the transducer 10 power amplifier 202. The signal from the phase inverter 192 is coupled through the equalizer 196 and, for a "pure tone" sinusoidal waveform input signal, appears as the sinusoidal waveform 206 across potentiometer 200. The wiper of potentiometer 200 is coupled to the +input terminal of a difference amplifier 208. The output terminal of amplifier 208 is coupled to the bases of complementary symmetry transistors 210, 212 which are coupled between +and −40 VDC supply terminals 214, 216, respectively.

The joined emitters of transistors 210, 212 are coupled through a 1 K resistor to common. The collector of transistor 210 is coupled through a 2×3.3 K voltage divider to +40 VDC. The collector of transistor 212 is coupled through a 2×3.3 K voltage divider to −40 VDC. The junction of the two 3.3 K resistors in the collector of transistor 210 is coupled to the gate of a P-channel MOSFET 215 whose source is coupled to +40 VDC and whose drain is coupled through the 4.7 Ω, 50 W power resistor 217 to transducer 10, and to the drain of an N-channel MOSFET 218. The gate of FET 218 is coupled to the junction of the 3.3 K resistors in the collector circuit of transistor 212. The source of FET 218 is coupled to −40 VDC. When the circuit is amplifying waveform 206, a slightly clipped sinusoidal waveform 220 appears at the joined drains of FETs 215 and 218. The common drains of FETs 215 and 218 also supply feedback through a 220 K resistor 222 to the −input terminal of amplifier 208. An equalization circuit including the series combination of a 10 K resistor and a 1 μF capacitor and the series combination of a 3.3 K resistor and a 0.01 μF capacitor in parallel is coupled between the −terminal of amplifier 208 and common.

The anti-clipping circuit 190 includes oppositely poled diodes 224, 226. The anode of diode 224 and cathode of diode 226 are coupled to the joined emitters of transistors 210, 212. The cathode of diode 224 is coupled to the +input terminal of a difference amplifier 228 and through a 47 K resistor to common.

The anode of diode 226 is coupled through a 47 K resistor to the −input terminal of amplifier 228. The output terminal of amplifier 228 is coupled through a 47 K feedback resistor to its −input terminal. The sinusoidal input waveform 206 results in waveforms 230 and 232 at the joined emitters of transistors 210 and 212 and at the output terminal of amplifier 228, respectively, as the circuit including diodes 224, 226 and amplifier 228 rectifies and threshold limits waveform 230 to produce waveform 232. This signal is provided through a diode 234 and a 10 K resistor to the base of a transistor 236. The emitter of transistor 236 is coupled to common. Its collector is coupled through a 3.3 K series resistor and a current source to a +15 VDC supply. Waveform 238 appears at the collector of transistor 236 in response to waveform 232 at the output terminal of amplifier 228. A 1 μF capacitor 240 is coupled across transistor 236 and its 3.3 K collector resistor. The DC control voltage to the VCA 182 appear across capacitor 240. This control voltage is also fed back through a diode 242 to the anode of diode 234.

What is claimed is:

1. A transducer for a musical instrument, the musical instrument having an instrument body through which vibrations can be fed back to the instrument to sustain notes played on the instrument, the transducer comprising a core constructed from electromagnetic material, the core having a spine and a pair of legs extending away from the spine, a resilient, non-electromagnetic, non-magnetic material having two opposed side surfaces, means for mounting the core on one of said side surfaces, a conductor wound on the core so that energization of the conductor causes opposite magnetic poles to exist at the end faces of the legs remote from the spine, and means for mounting the transducer on the instrument body, a permanent magnetic pole associated with each leg, the permanent magnetic poles being opposite, means for mounting the permanent magnetic poles adjacent end faces of respective legs between the means for mounting the transducer on the instrument body and the other of said side surfaces of the resilient material, and means for feeding back electrical signals corresponding to musical note vibrations to the conductor to sustain such vibrations.

2. The apparatus of claim 1 wherein the core is somewhat E-shaped, the pair of legs comprising an end leg and a center leg, and further comprising another end leg, the transducer further comprising a third permanent magnetic pole and means for mounting the third permanent magnetic pole adjacent an end face of said other end leg between the means for mounting the transducer on the instrument body and the other of said side surfaces of the resilient material with third permanent magnetic pole being opposite to the permanent magnetic pole adjacent the end face of the center leg.

3. The apparatus of claim 2 wherein the means for mounting the transducer on the instrument body comprises a bracket, means for attaching the three permanent magnetic poles to the bracket so that opposite first and second permanent magnetic poles project away from the bracket, like first and third permanent magnetic poles project away from the bracket, and the second permanent magnetic pole lies generally between the first and third permanent magnetic poles, and means for mounting the bracket on the instrument body.

4. The apparatus of claim 1 wherein the means for mounting the transducer on the instrument body comprises a bracket, means for attaching the permanent magnetic poles to the bracket so that opposite permanent magnetic poles project away from the bracket, and means for mounting the bracket on the instrument body.

5. In combination, a musical instrument and a transducer comprising a core constructed from electromagnetic material, the core having a spine and first and second legs extending away from the spine, a generally flat sheet of a non-electromagnetic, non-magnetic resilient material, means for mounting the core on a surface of the resilient material, a conductor wound on the core so that energization of the conductor causes opposite magnetic poles to occur at end faces of the first and second legs remote from the spine, first and second permanent magnetic poles for the first and second legs, respectively, means for mounting the permanent magnetic poles adjacent the end faces of respective legs on a surface of the resilient material opposite the surface on which the core is mounted with the permanent magnetic poles poled in opposite directions, means for mounting the transducer upon the musical instrument, and means for feeding back electrical signals corresponding to musical note vibrations to the conductor to sustain such vibrations.

6. The combination of claim 5 wherein the core further comprises a third leg extending away from the spine making the core somewhat E-shaped, a third permanent magnetic pole and means for mounting the third permanent magnetic pole adjacent the end face of the third leg on the surface of the resilient material opposite the surface on which the core is mounted with the third permanent magnetic pole poled in the opposite direction to its nearest neighbor of the first and second permanent magnetic poles.

7. The combination of claim 6 wherein the means for mounting the transducer upon the musical instrument comprises a mounting plate, means for attaching the three permanent magnetic poles to the mounting plate so that the first and second magnetic poles are opposite and project away from the mounting plate, the first and third magnetic poles are like and project away from the mounting plate, and the second magnetic pole lies generally between the first and third magnetic poles, and means for mounting the mounting plate on the musical instrument.

8. The combination of claim 5 wherein the means for mounting the transducer upon the musical instrument comprises a mounting plate, means for attaching the permanent magnetic poles to the mounting plate so that opposite first and second permanent magnetic poles project away from the mounting plate, and means for mounting the mounting plate on the musical instrument.

9. A transducer for a musical instrument through which vibrations can be fed back to the instrument so that notes played on the instrument can be sustained, the transducer comprising a bracket for mounting the transducer to the instrument, a first permanent magnetic pole, means for mounting the first permanent magnetic pole so that it projects away from the bracket, a second permanent magnetic pole, means for mounting the second permanent magnetic pole so that it projects away from the bracket, the second permanent magnetic pole being opposite to the first, a sheet of a non-magnetic, non-electromagnetic resilient material, means for attaching a first surface of the sheet of resilient material to the projecting first and second magnetic poles, an electromagnetic core having a spine and first and second legs originating at, and extending away from, the spine and terminating at first and second end faces, respectively, a conductor wound on the core, varying current flow in the conductor inducing flux variations in the core, and means for attaching the first and second end faces to a surface of the sheet opposite the surface of the sheet to which the permanent magnetic poles are attached, with the first face adjacent the first permanent magnetic pole and the second face adjacent the second permanent magnetic pole.

10. The apparatus of claim 9 and further comprising a third permanent magnetic pole, means for mounting the third permanent magnetic pole so that it projects away from the bracket, the third permanent magnetic pole being like the first permanent magnetic pole, means for attaching the first surface of the sheet of resilient material to the projecting third magnetic pole, the electromagnetic core further including a third leg originating at, and extending away from, the spine and terminating at a third end face, and means for attaching the third end face to the surface of the sheet opposite the surface to which the permanent magnetic pole are attached, with the third face adjacent the third permament magnetic pole.

11. The apparatus of claim 10 wherein the first and third magnetic poles are mounted on the bracket in spaced orientation with the second permanent magnetic pole mounted on the bracket generally between them.

12. A system for feeding back musical note vibrations to a musical instrument to sustain the playing time of the musical note on the instrument, the instrument being sensitive to the phase of the vibrations fed back to it, the system comprising means for conditioning an electrical signal corresponding to the played note to provide a conditioned electrical signal at a level at which the conditioned electrical signal can be fed back to the musical instrument to sustain the playing time of the musical note, means for coupling the musical instrument to the conditioning means, and means for coupling the conditioning means to the musical instrument, the conditioning means including a digital shift registor having an input terminal and an output terminal, an A/D converter, a D/A converter, means for coupling the A/D converter to the input terminal of the digital shift register and means for coupling the output terminal of the digital shift register to the D/A converter, at least one of the input terminal to the digital shift register and the output terminal from the digital shift register being selectively variable for providing a selectively variable time delay for controllably and selectively varying the phase between the played note and the conditioned electrical signal.

13. A system for feeding back musical note vibrations to a musical instrument to sustain the playing time of the musical note on the instrument, the instrument being sensitive to the phase of the vibrations fed back to it, the system comprising means for conditioning an electrical signal corresponding to the played note to provide a conditioned electrical signal at a level at which the conditioned electrical signal can be fed back to the musical instrument to sustain the playing time of the musical note, means for coupling the musical instrument to the conditioning means, and means for coupling the conditioning means to the musical instrument, the conditioning means including a series of CCDs having an input terminal and an output terminal, at least one of the input terminal to the series of CCDs and the output terminal from the series of CCDs being selectively variable for providing a selectively variable time delay for controllably and selectively varying the phase between the played note and the conditioned electrical signal.

14. A system for feeding back musical note vibrations to a musical instrument to sustain the playing time of the musical note on the instrument, the instrument being sensitive to the phase of the vibrations fed back to it, the system comprising means for conditioning an electrical signal corresponding to the played note to provide a conditioned electrical signal at a level at which the conditioned electrical signal can be fed back to the musical instrument to sustain the playing time of the musical note, means for coupling the musical instrument to the conditioning means, and means for coupling the conditioning means to the musical instrument, the conditioning means comprising an audio amplifier, a splitter, a loudspeaker, a transducer, means for coupling the musical instrument to the audio amplifier to amplify the level of the electrical signal, means for coupling the audio amplifier to the splitter to split the amplified signal into two channels, means for coupling the splitter to the loudspeaker to provide an audio signal corresponding to the musical note, means for coupling the splitter to the transducer and means for coupling the transducer to the musical instrument to feed back to the musical instrument mechanical vibrations corresponding to the musical note, the conditioning means controllably and selectively varying the phase between the played note and the conditioned electrical signal to sustain the playing time of the musical note.

* * * * *